United States Patent [19]

Hamisch, Sr.

[11] 3,971,497

[45] July 27, 1976

[54] TAG ATTACHING APPARATUS

[75] Inventor: Paul H. Hamisch, Sr., Dayton, Ohio

[73] Assignee: Monarch Marking Systems, Inc., Dayton, Ohio

[22] Filed: Apr. 24, 1975

[21] Appl. No.: 571,342

[52] U.S. Cl. ..... 227/67
[51] Int. Cl.[2] ..... B25C 1/00
[58] Field of Search ..... 227/67

[56] References Cited

UNITED STATES PATENTS 3,650,451 3/1972 Weiland et al. ..... 227/67

3,759,435 9/1973 Bone ..... 227/67

*Primary Examiner*—Granville Y. Custer, Jr.
*Attorney, Agent, or Firm*—Joseph J. Grass

[57] ABSTRACT

There is disclosed a plurality of embodiments of tag attaching apparatus of the type having a hollow needle with a slot along one side, an ejector or push rod aligned with the needle, and feeding means for successively advancing an assembly of fasteners into position to be pushed through the needle by means of the push rod.

12 Claims, 21 Drawing Figures

FIG-1
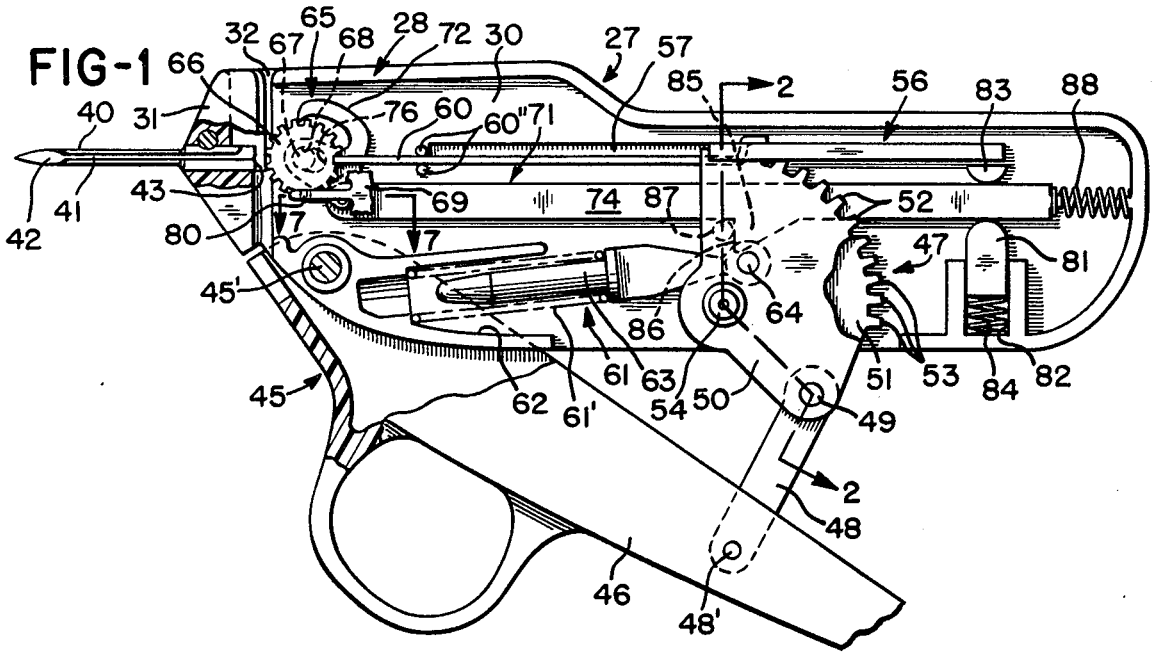
FIG-2
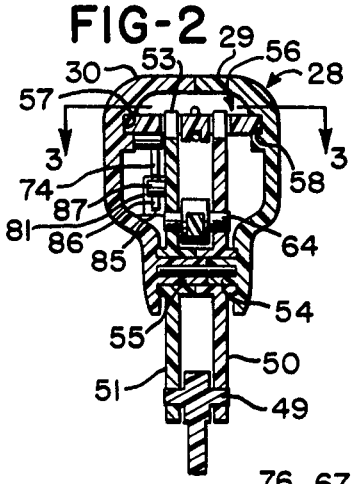
FIG-3
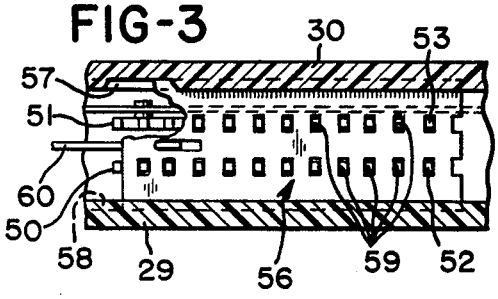
FIG-4
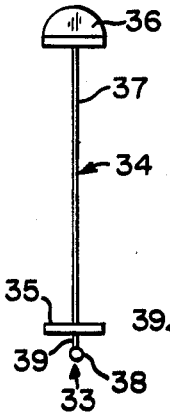
FIG-5
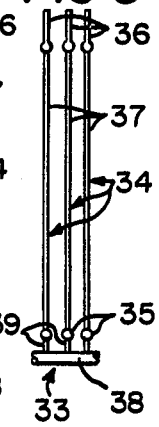
FIG-6
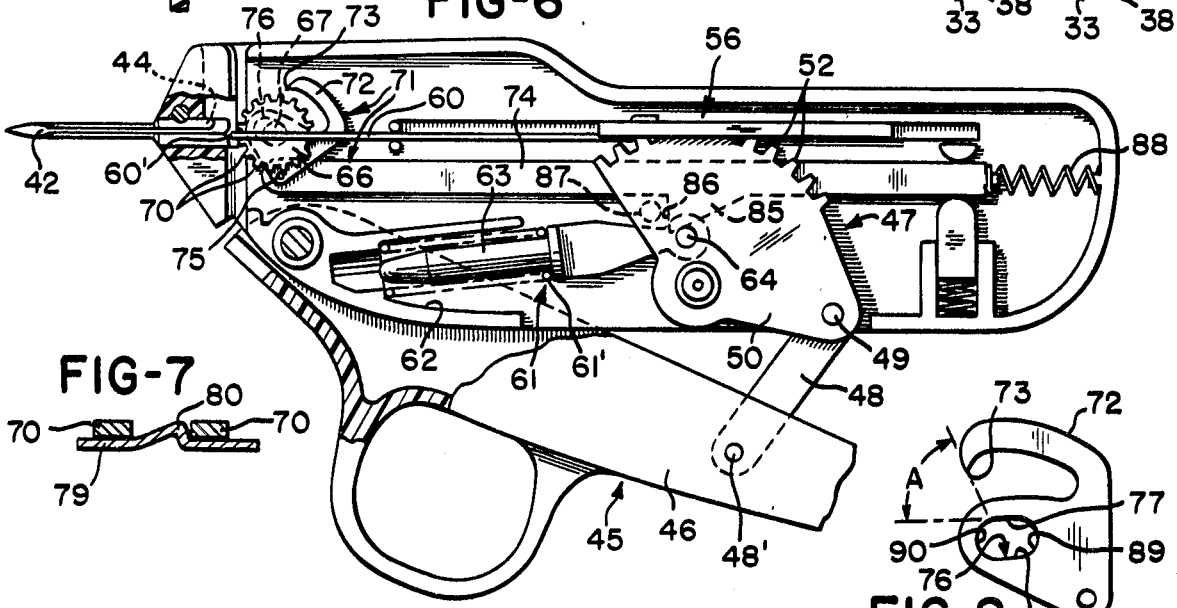
FIG-7
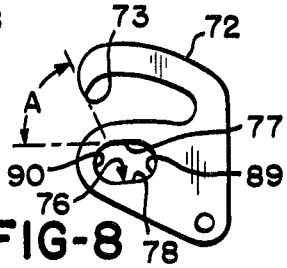
FIG-8

FIG-18
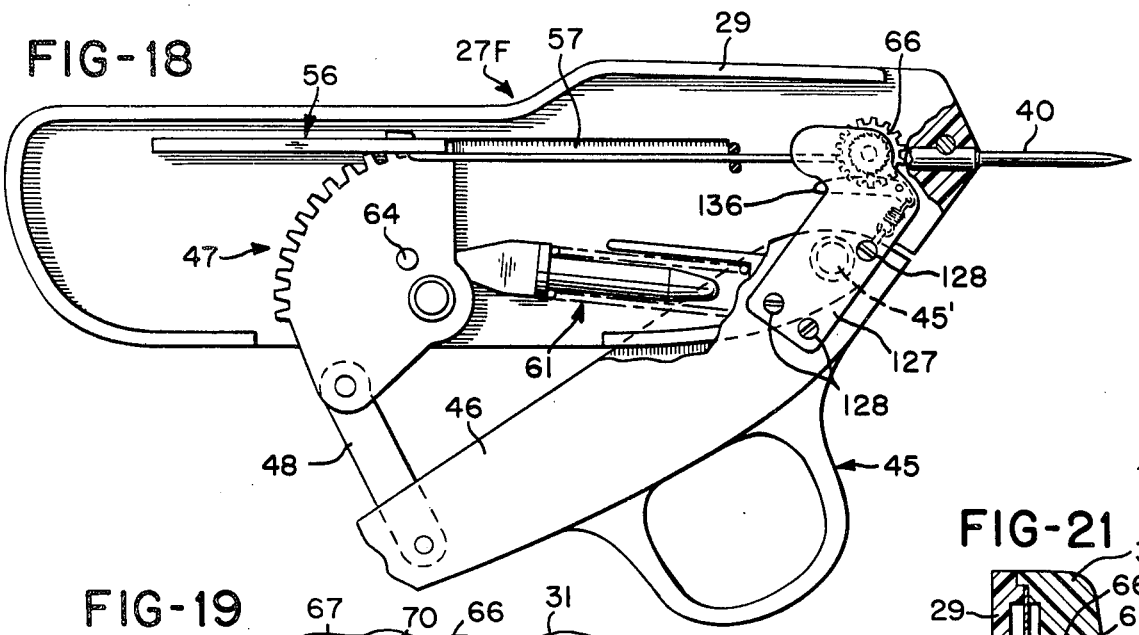
FIG-21
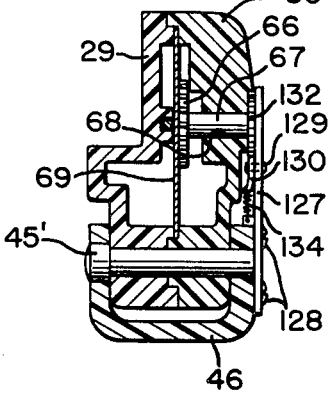
FIG-19
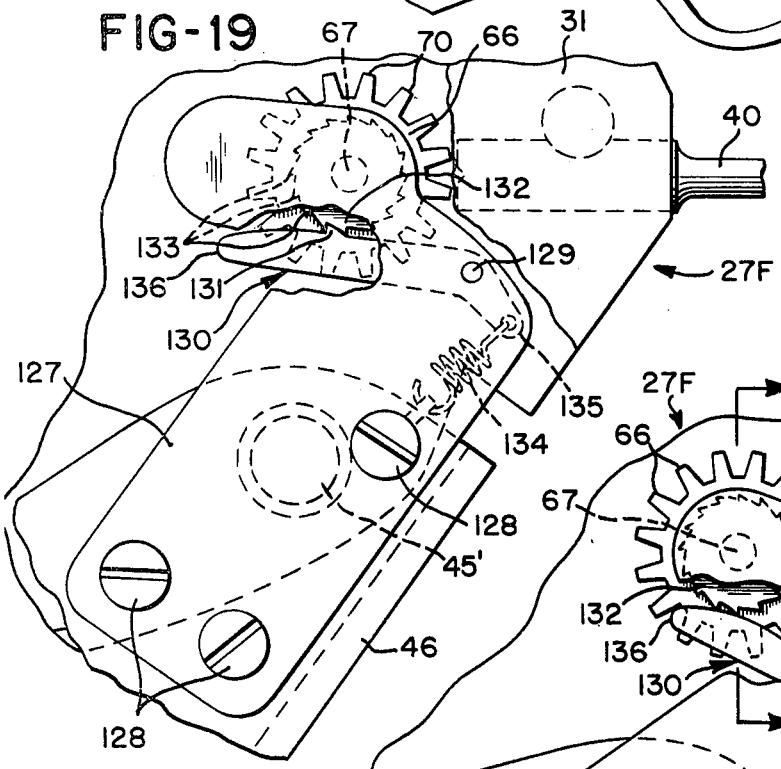
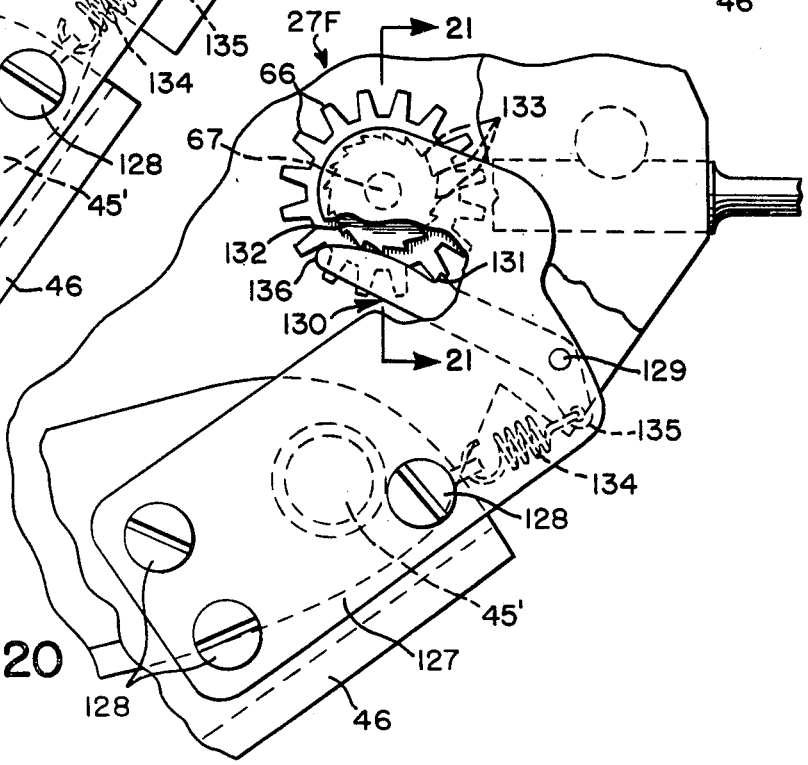
FIG-20

TAG ATTACHING APPARATUS

BACKGROUND OF THE INVENTION

1. Field of the Invention

This invention relates to the art of tag attaching apparatus.

2. Brief Description of the Prior Art

U.S. Pat. No. 3,103,666 to A. R. Bone dated Sept. 17, 1963 discloses a tag attaching apparatus having a slotted needle, a push rod or plunger for driving a bar of a fastener through the needle, a toothed wheel for advancing a fastener assembly, a pivotally mounted knife for severing an attachment which is in register with the needle from the remainder of the fastener assembly, and a hand lever including means for operating the toothed wheel, the knife and the push rod in sequence. Japanese Utility Model Registration Ser. No. 949,012 to T. Kameya et al. dated Dec. 13, 1971 discloses a tag attaching apparatus including a needle, an index wheel, a push rod, a slide, a knife, and a hand lever for actuating the slide. The slide carries the push rod and actuates the pawl that cooperates with the index wheel. U.S. Pat. No. 3,650,452 to E. W. Finke dated Mar. 21, 1972 discloses a tag attaching apparatus having a needle, a feed wheel coupled to a ratchet wheel, a push rod, a slide and a hand lever for driving the push rod and the slide, the slide having spaced apart abutments for driving a pawl by means of a pin received in a slot in the slide. When the hand lever is actuated, the push rod and slide are operated. When the pin contacts one end of the slot the tooth of the pawl is driven over a tooth of a ratchet wheel. When the hand lever is released, a return spring causes the pin to engage the other end of the slot, thereby driving the pawl to cause the ratchet and feed wheels to advance the fastener assembly. U.S. Pat. No. 3,652,004 to B. Lozio dated Mar. 28, 1972, includes a needle, a push rod, a kinematic mechanism, and a hand lever for driving the push rod and the kinematic mechanism. The kinematic mechanism includes a pivotally mounted pawl cooperable with a ratchet wheel to feed a fastener assembly to the needle and the push rod. U.S. Pat. No. 3,759,435 to A. R. Bone dated Sept. 18, 1973 discloses a tag attaching apparatus including a slotted needle, a push rod, a toothed wheel, a toothed member cooperable with the toothed wheel, a slide for driving the push rod and the pawl, gear means for driving the slide, and a hand lever for driving the gear means. When the hand lever is actuated, the push rod drives a bar section of a fastener through the needle. When the hand lever is released, spring means returns the push rod and causes the toothed member to drive the toothed wheel. A release control is provided to pull the pawl away from the teeth of the toothed wheel to permit the fastener assembly to be pulled out of the apparatus.

SUMMARY OF THE INVENTION

The invention relates to improvements to tag attaching apparatus especially to apparatus according to U.S. Pat. No. 3,759,435. In one embodiment, the apparatus includes a slotted needle having a side opening, a toothed wheel, a pawl cooperable with the toothed wheel, a push rod, a slide, a knife, an actuator, and gear means coupled to the actuator, the slide having a gear section cooperable with the gear means. Movement of the slide in one direction drives the push rod to sever a bar section of a fastener from a coupling member of the fastener assembly to push the bar section through the needle with the filament section extending through the side opening in the needle. This movement of the slide also drives the pawl from a first position to a second or ready position. Return spring means drives the actuator, the gear means, the slide and the push rod to their initial positions. A spring is effective to drive the pawl to the first position when the actuator is actuated and a projection carried by the gear segment cooperates with an abutment on the pawl to drive the pawl from the first position to the second position thereby advancing the fastener assembly to a position in which the bar section of the next successive fastener is aligned with the needle and the push rod. In another embodiment the slide is used only for driving the push rod, and the fastener assembly is advanced by a simple pawl and ratchet mechanism. The pawl is mounted on a pivot carried by a plate. The plate is secured directly to the hand lever, and a ratchet wheel secured coaxially to the feed wheel is driven by the pawl when the hand lever is released. The pawl has an extension or handle by which the pawl can be disengaged so that the fastener assembly can be removed from the apparatus.

BRIEF DESCRIPTION OF THE DRAWINGS

FIG. 1 is a side elevational view with certain parts broken away for clarity, showing operative components of a tag attaching apparatus in their initial positions;

FIG. 2 is a sectional view taken generally along line 2—2 of FIG. 1;

FIG. 3 is a fragmentary sectional view taken along line 3—3 of FIG. 2;

FIG. 4 is an end elevational view of a fastener assembly;

FIG. 5 is a fragmentary side elevational view of the fastener assembly shown in FIG. 4;

FIG. 6 is a view similar to FIG. 1, but showing the operative components in a different position than in FIG. 1;

FIG. 7 is a sectional view taken generally along line 7—7 of FIG. 1;

FIG. 8 is a side elevational view of a toothed member shown in FIGS. 1 and 6;

FIG. 18 is a side elevational view of another embodiment of tag attaching apparatus;

FIG. 19 is an enlarged side elevational view of a fragmentary portion of the apparatus shown in FIG. 18, showing the operating structure in the same relative position as in FIG. 18;

FIG. 20 is a view similar to FIG. 19, but showing the operating structure in a different relative position; and FIG. 21 is a sectional view taken generally along line 21—21 of FIG. 20.

DESCRIPTION OF THE PREFERRED EMBODIMENTS

Figure 9:
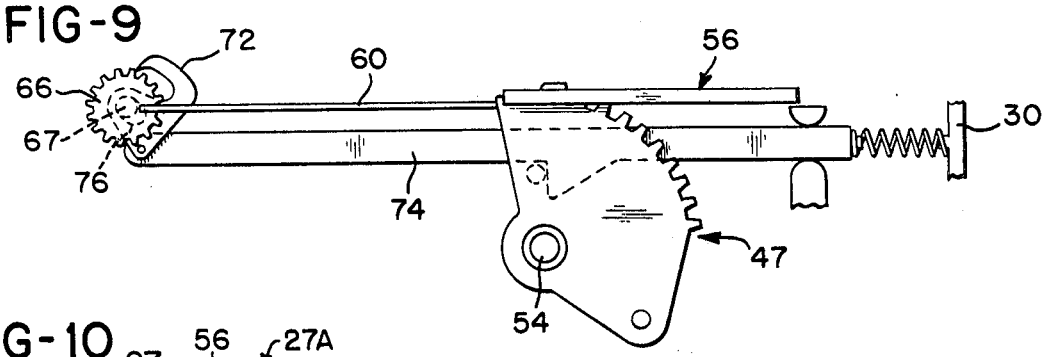
FIG. 9 is a fragmentary side elevational view of operating structure for advancing the fastener assembly for driving a fastener, but showing the structure in a different position from the positions shown in FIGS. 1 and 6.

Referring to the embodiment of FIGS. 1 through 9, there is disclosed a tag attaching apparatus generally indicated at 27. The apparatus 27 has a body 28 with two body sections 29 and 30. The body 28 has a nose portion 31 having a guideway 32 adapted to receive a fastener assembly 33 of the type shown in FIGS. 4 and 5. The fastener assembly 33 includes a plurality of fasteners 34. Each fastener 34 includes a head or bar section 35 and a head or button section 36 joined by a filament section 37. The fasteners 34 are connected to a common carrier member or runner 38 by respective coupling members 39. The guideway 32 is adapted to receive the common carrier member 38, the coupling members 39, and the bar section 35 and the filament sections 37 extend out of the side of the apparatus 27.

The nose portion 31 mounts a hollow needle 40 having an elongated slot 41. The bar section 35 is able to pass through the bore or passage 42 which extends through the needle 40 while its filament section 37 extends or projects through the slot 41. The needle 40 has a rear cutting edge 43 for cutting the bar sections 35 from their respective coupling members 39. The needle 40 has a slot 44 through which the bar sections 35 can descend into the needle 40. An actuator generally indicated at 45 is shown to comprise a hand lever 46 adapted to be engaged by the user's fingers. The hand lever 46 is pivotally mounted to the body 28 by a pin or shaft 45'. The lever 46 is drivingly connected to gear means generally indicated at 47 by a link or connecting member 48. The connecting member 48 is pivotally connected to the hand lever 46 by a pin 48' and to the gear means 47 by a pin 49. The gear means 47 is shown to comprise a pair of gear segments 50 and 51 having respective teeth 52 and 53. The gear segments 50 and 51 are in turn pivotally mounted to the body 28 by means of aligned posts 54 and 55 formed integrally with respective body sections 29 and 30. A slide generally indicated at 56 is guided for sliding movement in guideways or slots 57 and 58 in the respective body sections 29 and 30. The slide 56 has a plurality of sets of holes 59 to receive the teeth 52 and 53. Thus, the slide 56 includes a gear section or specifically a rack with which the gear segments 50 and 51 cooperate. An ejector or push rod 60 is securely held to the slide 56 so that the slide 56 and the push rod 60 move as a unit upon manual actuation of hand lever 46. The push rod 60 is guided by means of a guide member 60'' so that the push rod 60 moves in alignment with the bore 42 of the needle 40. When the user squeezes the hand lever 46 while the body 28 is against the palm of the user's hand, the hand lever 46 pivots counterclockwise (FIG. 1) about pin 45' and thus the gear means 47 pivots counterclockwise and the slide 56 and the push rod 60 are driven to the left. As the push rod 60 moves to the left it drives the bar section 35 of the fastener 34 through the needle 40 and in so doing causes the bar section 35 to be severed from its respective coupling member 39. A return spring mechanism generally indicated at 61 comprises a cavity 62 formed in the body 28 to allow movement of a telescoping member 63 received in the cavity 62. The telescoping member 63 is pivotally connected to the gear segments 50 and 51 by pin structure indicated at 64. One end of a compression spring 61' bears against the body 28 in the cavity 62 and its other end bears against member 63. When the hand lever 46 is released from the squeezing action exerted by the user, the return spring mechanism 61 will cause the hand lever 46, the member 48, the gear means 47, the slide 56 and the push rod 60 to return to their respective initial positions shown in FIG. 1.

The apparatus 27 includes fastener assembly feeding mechanism generally indicated at 65 for feeding the fastener assembly 34 to position one bar section 35 at a time into alignment with the bore 42 of the needle 40. The feeding mechanism 65 is shown to include a toothed wheel 66 secured to a shaft 67 rotatably mounted in a hole 68 in the body section 30. The toothed wheel 66 is positioned in a space between a cover 69, shown broken away in FIG. 1 but shown more fully in U.S. Pat. No. 3,759,435, and body portion 30. The gear 66 has a plurality of teeth 70 disposed on the periphery for engaging the coupling members 39. The wheel 66 is rotated counterclockwise (FIGS. 1, 6 and 9) by action of a cooperable pawl generally indicated at 71. The pawl 71 is mounted for generally reciprocable movement and is constructed using two basic parts, namely a toothed member 72 having a tooth 73 and a link or link member 74. A pin 75 pivotally connects the members 72 and 74. The member 72 is provided with slot generally indicated at 76 through which the shaft 67 extends. The member 72 is adapted to rock back and forth over the shaft 67 as the result of movement of link member 74. The tooth 73 is hook-like and engages one tooth 70 at a time of the toothed wheel 66 to rotate it. The slot 76 has parallel upper and lower walls 77 and 78 which are angularly disposed with respect to tooth 73 so that when the member 72 is rocked in one direction, the tooth 73 is cammed out of engagement with the wheel 66 and when rocked in the opposite direction the tooth 73 is cammed into engagement with the wheel 66. There exists an acute angle A between the parallel walls 77 and 78 and tooth 73 to effect the camming movement. When the member 72 is moved sufficiently by the link member 74 the one end of the slotted hole 76 contacts the shaft 67. Because the walls 77 and 78 are angled with respect to the tooth 73, movement in one direction causes tooth 73 to cam out of engagement between the two adjacent teeth 70 and movement in the other direction causes tooth 73 to cam into engagement with wheel 66. Further movement of the member 72 in the direction which causes engagement will then cause rotation of the wheel 66. In order to prevent wheel 66 from rotating as the member 72 is rocked back and forth relative to the wheel 66 there is provided on member 69 a resilient member 79 having a projection or detent 80. The detent 80 is adapted to be positioned in the space between two adjacent teeth 70 to prevent the wheel 66 from rotating except when actuated by the member 72 or when the fastener assembly 34 is pulled upwardly out of the guideway 32. The link member 74 is slidably mounted in the body 28 between the initial position shown in FIG. 1 and the position shown in FIG. 6. The link member 74 is supported at its rearward end by a member 81 slidably movable in a cavity 82 in the body section 30. The member 81 is urged upwardly against pawl member 75 by a spring 84 toward a projection or pin 83. The structure described above under this heading is the same as in U.S. Pat. No. 3,759,435 to which further reference may be made for further constructional details.

Referring now to the present improvement, FIG. 1 shows the link member 74 as having a single abutment or projection 85 depending in the downward direction. The abutment 85 has an abutment or stop face 86 with which a pin or projection 87 connected to the gear segment 51 can cooperate. In the position shown in FIG. 1, the projection 87 bears against the abutment face 86 in counteraction to a compression spring 88. One end of the spring 88 bears against the rearward end of the link member 74 and the other end of the spring 88 bears against body section 30. In the position shown in FIG. 1, the member 72 is in its initial position in the sequence of operation which is the same as its final position in the sequence. When the actuator 45 is squeezed, the gear means 47 and hence the projection 87 move counterclockwise and during such counterclockwise movement the link member 74 moves to the left (FIG. 1) under the biasing action of the spring 88. As the link member 74 moves to the left from the position shown in FIG. 1 through the position shown in FIG. 9 toward the position shown in FIG. 6 the projection 87 loses contact with the stop face 86 when the lefthand movement of the link member 74 is arrested due to the face that the shaft 67 is now in contact with one end 89 of the slot 76. When the user discontinues squeezing the actuator 45, the return spring mechanism 61 causes the gear means 47 to rotate clockwise and when the projection 87 moves into contact with the abutment face 86, the projection 87 begins driving the link member 74 to the right against the action of the spring 88. When the gear means 47 nears the end of its clockwise movement, the link member 74 drives the member 72 to a position in which end 90 of the slot 76 contacts the shaft 67 and pivots the member 72 counterclockwise from the position shown in FIG. 6 to the position shown in FIG. 1. As the link member 74 continues to be driven to the right by clockwise rotation of the gear means 47 and projection 87, the toothed member 72 drives the wheel 66 counterclockwise. The counterclockwise rotation of the wheel 66 brings the next successive bar section 35 into alignment with the needle bore 42 and the end 60' of the push rod 60. Thus, the wheel 66 rotates through such an angle as to advance the fastener assembly 33 through a distance equal to the distance from the centerline of one bar section 35 to the centerline of the next adjacent bar section 35. The springs 61' and 88 are shown to be in force opposition. It is noted that the spring 88 is relatively light and the spring 61 is relatively heavy so that release of the hand lever 46 by the user overcomes the force of the spring 88.

Briefly stated the sequence of operation of the apparatus 27 is as follows, assuming the apparatus has been loaded with a fastener assembly 33. The user squeezes the actuator 45, which causes the gear means 47 to pivot counterclockwise (FIG. 1) to drive the slide 56 and the push rod 60 to the left (FIG. 1). When the end 60' of the push rod 60 acts on one end of the bar section 35, the knife 43 severs the coupling member 39 and the bar section 35 continues to move through the needle 40 as the push rod 60 continues to move. While the gear means 47 is pivoting counterclockwise, the link member 74 moves to the left under the action of the spring 88, thereby moving the member 72 from the position shown in FIG. 1 to the position shown in FIG. 6. When the user releases the squeeze on the actuator 45, the return spring mechanism 61 drives the gear means 47 clockwise (FIG. 6) to withdraw the push rod 60 from the needle 40 and move end 60' clear of the next bar section 35 to enable its descent into the needle through the slot 44. Continued clockwise movement causes the projection 87 to contact abutment face 86 to drive link member 74 to the right to thus move the member 72 to a position between adjacent teeth 70 of the wheel 66 and to drive the wheel 66 to in turn advance the fastener assembly 33.

Figure 10:
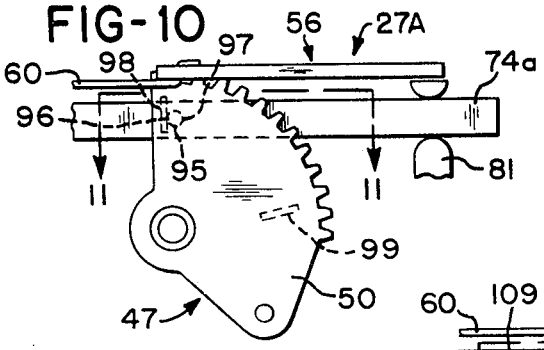
FIG. 10 is a fragmentary side elevational view of operating structure for advancing the fastener assembly and for driving a fastener, in accordance with a different embodiment.
Figure 11:
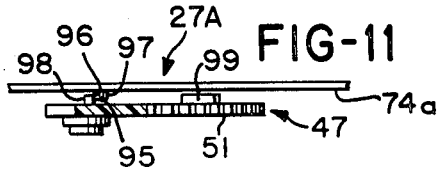
FIG. 11 is a sectional view taken along line 11—11 of FIG. 10.

With reference to the embodiment of FIGS. 10 and 11 of the drawings, the tag attaching apparatus 27A is the same as the tag attaching apparatus 27 except as shown in the drawings and indicated below. Like parts in the embodiment of FIGS. 10 and 11 are shown with like reference characters as in the embodiment of FIGS. 1 through 9. The link member **74*a* differs from the link member 74 in that the link member 74*a* has an abutment or stop 95 with abutment or stop faces 96 and 97. The gear means 47 has a pair of radially spaced apart projections or pins 98 and 99. When the gear means 47 is in the position shown in FIGS. 10 and 11, the link member 74*a* is in the position of the link member 74 in FIG. 1, and associated parts such as the push rod 60 and the toothed wheel 66 and the toothed member 72 are in their respective positions shown in FIG. 1. When the user squeezes the actuator 45, the gear means 47 is pivoted counterclockwise (FIG. 10) and when the projection 99 starts contacting the abutment face 97 of the abutment 95, the link member 74*a* is driven to the left, thereby driving the member 72 to the position of FIG. 6. In the meantime the push rod 60 has pushed a bar section 35 through bore 42 of the needle 40. When the user ceases squeezing the actuator 45, the return spring mechanism 61 drives the gear means 47 clockwise, and when the projection 98 starts contacting the abutment face 96 of the abutment 95, the link member 74*a* is driven to the right until the gear means 47 has reached the initial position shown in FIG. 10, thereby driving the toothed wheel 66 to advance the fastener assembly 33.**

Figure 12:
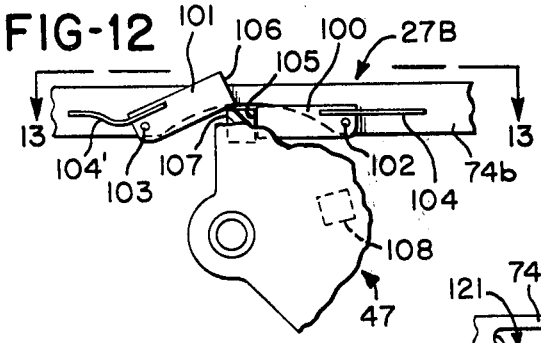
FIG. 12 is a fragmentary side elevational view of operating structure for advancing the fastener assembly and for driving a fastener, in accordance with another embodiment.
Figure 13:
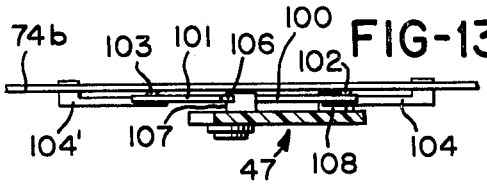
FIG. 13 is a sectional view taken along line 13—13 of FIG. 12.

With reference to the embodiment of FIGS. 12 and 13, the tag attaching apparatus 27B is the same as the tag attaching apparatus 27 except as shown in the drawings and indicated below. Like parts in the embodiment of FIGS. 12 and 13 are shown with like reference characters as in the embodiment of FIGS. 1 through 9. The link member **74*b* differs from the link member 74 in that it mounts a pair of abutment members 100 and 101 which are mounted on and independently movable relative to the link member 74*b* by respective pivots 102 and 103. The abutment members 100 and 101 are urged to respective positions parallel to link member 74*b* by respective leaf springs 104 and 104'. The abutment members 100 and 101 have respective abutment or stop faces 105 and 106. The gear means 47 has a pair of radially spaced apart projections or pins 107 and 108. When the gear means 47 is in the position shown in FIGS. 12 and 13 the link member 74*b*** is in the position of the link member 74 in FIG. 1, and associated parts such as the push rod 60 and the toothed wheel 66 and the member 72 are in their respective positions shown in FIG. 1. When the user squeezes the actuator 45, the gear means 47 is pivoted counterclockwise (FIG. 12) and the projection 107 moves out of contact with the abutment face 105. As the gear means 47 and the projection 107 move counterclockwise the spring 104' urges the abutment member 101 clockwise to a position parallel to the link member 74*b*. When the projection 108 contacts the lower surface of the abutment member 100, the projection 108 pivots the abutment member 100 clockwise against the urging of the spring 104 and near the end of travel of the projection 108, the projection 108 contacts the abutment face 106 of the abutment member 101 and thereby drives the link member 74*b* to the left. This causes member 72 to move from the position shown in FIG. 1 to the position shown in FIG. 6. When the user ceases squeezing the actuator 45, the gear means 47 is driven clockwise by the return spring mechanism 61, the abutment member 101 is pivoted counterclockwise by the projection 107, and when the gear means 47 nears the initial position, the projection 107 contacts the abutment face 105 and drives the link member 74*b* to the right, thereby causing the toothed member 72 to advance the toothed wheel 66 to advance the fastener assembly 33.

Figure 14:
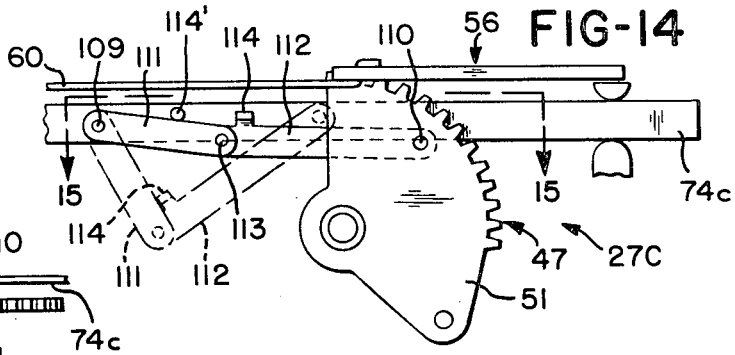
FIG. 14 is a fragmentary side elevational view of operating structure for advancing the fastener assembly and for driving a fastener, in accordance with another embodiment.
Figure 15:
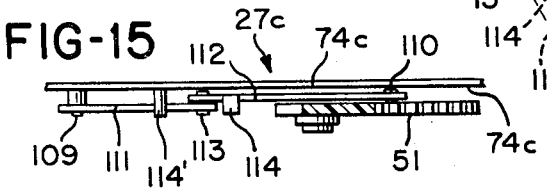
FIG. 15 is a sectional view taken along line 15—15 of FIG. 14.

With reference to the embodiment of FIGS. 14 and 15, the tag attaching apparatus 27C is the same as the tag attaching apparatus 27 except as shown in the drawings and indicated below. Like parts in the embodiment of FIGS. 14 and 15 are shown with like reference characters as in the embodiment of FIGS. 1 through 9. The link member 74*c* differs from the link member 74 in that it carries a pivot 109 and the gear segment 51 carries a pivot 110. A link 111 is pivotally connected to the pivot 109, and the gear segment 51 carries a pivot 110. Links 111 and 112 are pivotally connected to each other by means of a pivot 113. The link 112 has an integrally formed turned out tag which provides a stop 114. The stop 114 is disposed in the plane of the link 111 so that when the links 111 and 112 buckle to the phantom line positions shown in FIG. 14 the stop 114 limits the relative pivotal movement of the links 111 and 112. Thus, when the actuator 45 is squeezed, the gear means 47 begins to pivot counterclockwise (FIG. 14) and the links 111 and 112 pivot without imparting any motion to the link member 74*c*. However, when the abutment 114 contacts the link 111 and upon continued counterclockwise rotation of the gear means 47, the link member 74*c* is driven to the left (FIG. 14), thereby moving the member 72 from the position shown in FIG. 1 to the position shown in FIG. 6. When the user ceases squeezing the actuator 45, the return spring mechanism 61 pivots the gear means 47 clockwise and the links 111 and 112 move to the solid line position shown in FIG. 14 in which the link 111 contacts stop pin or projection 114' carried by the link member 74*c*. Upon continued clockwise rotation of the gear means 47, the link 111 exerts a pulling force on the link member 74*c* to drive the pawl member 74*c* to the right (FIG. 14), thereby driving member 72 to drive the wheel 66 to advance the fastener assembly 33.

Figure 16:
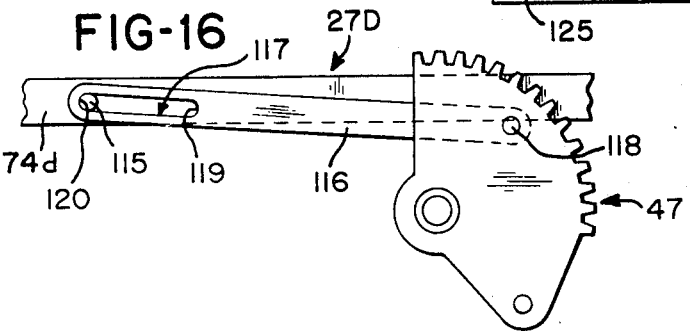

With reference to the embodiment of FIG. 16, the tag attaching apparatus 27D is the same as the tag attaching apparatus 27 except as shown in the drawings and indicated below. Like parts in the embodiment of FIG. 16 are shown with like reference characters as in the embodiment of FIGS. 1 through 9. The link member 74*d* is like the link member 74 except it carries a projection 115. A link 116 has an elongated slot or cutout generally indicated at 117 in which the projection 115 is received. The link 116 is pivotally connected to the gear means 47 by a pin 118 secured to the gear means 47. When the actuator 45 is squeezed, the gear means 47 pivots counterclockwise and the link 116 is driven to the left from the position shown. When abutment end 119 of the slot 117 contacts the projection 115, the pawl member 74*d* is driven to the left, thereby causing the member 72 to be driven from the position shown in FIG. 1 to the position shown in FIG. 6. When the user ceases squeezing the actuator 45, the return spring mechanism 61 rotates the gear means 47 clockwise and the link 116 is driven to the right. When other abutment end 120 of the slot 117 contacts the projection 115 and upon continued clockwise rotation of the gear means 47, the link 116 exerts a pulling force on the link member 74*d* to drive the pawl member 74*d* to the right, thereby driving the member 72 to drive the wheel 66 to advance the fastener assembly 33.

Figure 17:
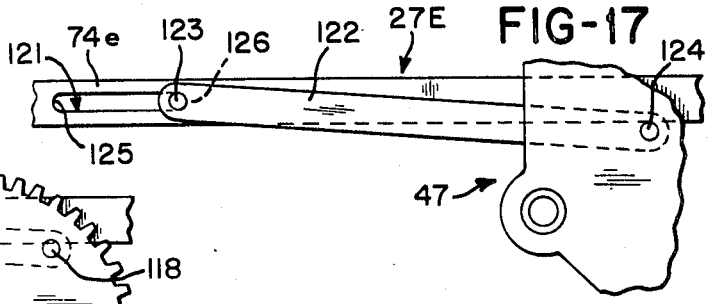
FIGS. 16 and 17 are fragmentary side elevational views of different embodiments of operating structures for advancing the fastener assembly and for driving a fastener.

With reference to the embodiment of FIG. 17, the tag attaching apparatus 27E is the same as the tag attaching apparatus 27 except as shown in the drawings and indicated below. Like parts of the embodiment of FIG. 17 are shown with like reference characters as in the embodiment of FIGS. 1 through 9. The link member 74*e* is like the link member 74 except that it has an elongated slot or cutout generally indicated at 121. A link 122 carries a projection or pin 123. The gear means 47 carries a pin 124 to which the link 122 is pivotally connected. When the actuator 45 is squeezed, the gear means 47 pivots counterclockwise and the link 122 is driven to the left from the position shown. When the projection 123 contacts end or abutment 125 of the cutout 121, the pawl 74*e* is driven to the left, thereby causing the member 72 to be driven from the position shown in FIG. 1 to the position shown in FIG. 6. When the user ceases squeezing the actuator 45, the return spring mechanism 61 rotates the gear means 47 clockwise and the link 122 is driven to the right. When the projection 123 contacts other end or abutment 126 of the cutout 121 and upon continued clockwise rotation of the gear means 47, the link 122 exerts a pulling force on the link member 74*e* to drive the link member 74*e* to the right, thereby driving member 72 to drive the wheel 66 to advance the fastener assembly 33.

The tag attaching apparatus 27F is the same as the tag attaching apparatus 27 except as shown in the drawings and indicated below. Like parts of the embodiment of FIGS. 18 through 21 are shown with like reference characters as in the embodiment of FIGS. 1 through 9. In the embodiment of FIGS. 18 through 21, the only function of the gear means 47 is to drive the slide 56. A plate 127 is secured to the hand lever 46 by fasteners 128. The plate 127 is generally flat and is constructed of metal. The plate 127 can be considered to be an extension of the hand lever 46. The plate 127 carries a post 129 which pivotally mounts a pawl 130. The pawl 130 is shown to be of one-piece construction unlike the pawl 71 used in the embodiments of FIGS. 1 through 17. The pawl generally indicated at 130 has a tooth 131 which is cooperable with a toothed wheel in the form of a ratchet wheel 132. The ratchet wheel 132 has a plurality of teeth 133 disposed at its periphery. The ratchet wheel 132 is secured to the shaft 67 to which the toothed wheel 66 is also secured. A tension spring 134 is connected to one end 135 of the pawl 130. The other end of spring 134 is connected to a tang secured to the plate 127. The post 129 is disposed between the end 135 and the tooth 131. The pawl 130 has a manually engageable extension 136 which extends beyond the tooth and which is disposed at an end of the pawl 130 opposite the end 135. The pawl 130 cooperates with the ratchet wheel 132 to advance the fastener assembly 33 through a distance equal to the distance from the centerline of one bar section 35 and the centerline of the next adjacent bar section 35 upon each full actuator of the hand lever 46, that is, squeezing the hand lever 46 drives the pawl 130 from the initial positions shown in FIGS. 18 and 19 to the position shown in FIG. 20, and release of the hand lever allows mechanism 61 to return the pawl 130 to its initial position and in so doing the pawl 130 drives the ratchet wheel 132.

Other embodiments and modifications of this invention will suggest themselves to those skilled in the art, and all such of these as come within the spirit of this invention are included within its scope as best defined by the appended claims.

I claim:

1. Apparatus for attaching tags using fasteners, the fasteners being arranged in an assembly, each fastener including a bar section and a head section joined by a filament section, the fasteners being coupled to a common carrier member by respective coupling members, the apparatus comprising: a body, a hollow needle having an elongated slot along one side supported by the body and extending outwardly of the body, a push rod supported by the body for driving a bar section of a fastener through the needle with a filament section of the fastener extending through the slot, means engageable with the coupling members to feed the fastener assembly so that one bar section of one fastener at a time can be brought into position to be pushed through the needle by the push rod, the feeding means including a toothed wheel, a pawl for engaging successive teeth of the wheel to advance the wheel, the pawl being movable between first and second positions, and means for actuating the push rod and the pawl in sequence, the actuating means including a spring for urging the pawl to the first position, a manually engageable actuator, a gear segment, a gear section driven by the gear segment for driving the push rod, an abutment carried by the pawl, a projection carried by the gear segment for driving the pawl from the first position to the second position to cause the feed wheel to feed the fastener assembly, and return spring means for returning the actuator, the push rod, the pawl, the gear segment and the gear section to their initial positions.

2. Apparatus as defined in claim 1, including means mounting the pawl for generally reciprocable movement, the spring comprising a compression spring having opposed ends, the one end of the spring abutting the body and the other end of the spring abutting the pawl.

3. Apparatus as defined in claim 1, wherein the spring is a relatively light spring and the return spring means includes a relatively heavy spring.

4. Apparatus as defined in claim 1, wherein the spring and the return spring means are in force opposition at the end portion of the sequence, but the return spring means exerts a greater effective force than the effective force exerted by the spring.

5. Apparatus as defined in claim 1, the projection acting on the abutment only at the beginning and end portions of the sequence, the spring being effective between the beginning and end portions of the sequence to drive the pawl to a position out of cooperation with the wheel, thereby enabling the fastener assembly to be removed from the apparatus.

6. Apparatus for attaching tags using fasteners, the fasteners being arranged in an assembly, each fastener including a bar section and a head section joined by a filament section, the fasteners being coupled to a common carrier member by respective coupling members, the apparatus comprising: a body, a hollow needle having an elongated slot along one side supported by the body and extending outwardly of the body, a push rod supported by the body for driving a bar section of a fastener through the needle with a filament section of the fastener extending through the slot, means engageable with the coupling members for feeding the fastener assembly so that one bar section of one fastener at a time can be brought into position to be pushed through the needle by the push rod, the feeding means including a toothed wheel, a pawl for engaging successive teeth of the wheel to advance the wheel, the pawl being movable between first and second positions, and means for actuating the push rod and the pawl in sequence, the actuating means including a spring for urging the pawl to the first position, a manually engageable actuator, a gear segment driven by the actuator, a gear section driven by the gear segment for driving the push rod, an abutment carried by the pawl, a projection carried by the gear segment for driving the pawl from the first position to the second position to cause the feed wheel to feed the fastener assembly, and return spring means for returning the actuator, the push rod, the pawl, the gear segment and the gear section to their initial positions, the pawl comprising a link member which carries the abutment and a toothed member coupled to the link member and having a tooth for engaging a tooth of the wheel.

7. Apparatus for attaching tags using fasteners, the fasteners being arranged in an assembly, each fastener including a bar section and a head section joined by a filament section, the fasteners being coupled to a common carrier member by respective coupling members, the apparatus comprising: a body, a hollow needle having an elongated slot along one side supported by the body and extending outwardly of the body, a push rod supported by the body for driving a bar section of a fastener through the needle with a filament section of the fastener extending through the slot, means engageable with the coupling members for feeding the fastener assembly so that one bar section of one fastener at a time can be brought into position to be pushed through the needle by the push rod, the feeding means including a toothed wheel, a manually engageable hand lever, a gear segment, a gear section driven by the gear segment for driving the push rod, a pivot carried by the hand lever, a pawl pivotally mounted on the pivot, a tooth carried by the pawl, a spring acting on the pawl and on the hand lever for urging the pawl into contact with the wheel, the hand lever being effective upon actuation to cause the push rod to be driven to drive a fastener through the needle and to drive the pawl from a first position to a second position, and return spring means for returning the hand lever, the push rod, the gear segment and the gear section to their initial positions and for driving the pawl from the second position to the first position to advance the fastener assembly.

8. Apparatus as defined in claim 7, including a manually engageable handle on the pawl for enabling disengagement of the pawl from the toothed wheel to enable the assembly to be removed.

9. Apparatus as defined in claim 7, wherein the feeding means further includes an indexing wheel secured against rotation of the toothed wheel for engaging the coupling members of the fastener assembly.

10. Apparatus as defined in claim 7, including a plate secured to the hand lever and the pivot being secured to the plate.

11. Apparatus for attaching tags using fasteners, the fasteners being arranged in an assembly, each fastener including a bar section and a head section joined by a filament section, the fasteners being coupled to a common carrier member by respective coupling members, the apparatus comprising: a body, a hollow needle having an elongated slot along one side supported by the body and extending outwardly of the body, a push rod supported by the body for driving a bar section of a fastener through the needle with a filament section of the fastener extending through the slot, means engageable with the coupling members for feeding the fastener assembly so that one bar section of one fastener at a time can be brought into position to be pushed through the needle by the push rod, the feeding means including a toothed wheel, a manually engageable hand lever, a pivot carried by the hand lever, a pawl mounted on the pivot and cooperable with the toothed wheel, a spring acting on the pawl and the hand lever for urging the pawl into contact with the wheel, the hand lever being effective upon actuation to cause the push rod to drive a fastener through the needle and to drive the pawl from a first position to a second position, and return spring means for returning the hand lever, the coupling means and the push rod to their initial positions and for driving the pawl from the second position to the first position.

12. Apparatus as defined in claim 11, including a plate secured directly to the hand lever, the pivot being mounted on the plate.

* * * * *